US007418758B1

(12) United States Patent
Avila

(10) Patent No.: US 7,418,758 B1
(45) Date of Patent: Sep. 2, 2008

(54) BASEBOARD CLEANING APPARATUS

(76) Inventor: Jorge Avila, 1360 Indian Trails, #12, Steamboat Springs, CO (US) 80487

( * ) Notice: Subject to any disclaimer, the term of this patent is extended or adjusted under 35 U.S.C. 154(b) by 0 days.

(21) Appl. No.: 11/850,363

(22) Filed: Sep. 5, 2007

(51) Int. Cl.
*A47L 13/146* (2006.01)

(52) U.S. Cl. ..... 15/119.2; 15/210.1; 15/228; 15/244.1

(58) Field of Classification Search ..... 15/116.2, 15/119.2, 210.1, 228, 244.1
See application file for complete search history.

(56) References Cited

U.S. PATENT DOCUMENTS 1,619,324 A * 3/1927 Allen ..... 15/115
2,469,060 A * 5/1949 Vosbikian et al. ..... 15/119.2
2,610,346 A * 9/1952 Pugh ..... 15/210.1
2,742,659 A * 4/1956 McGraw ..... 15/119.2
2,897,528 A * 8/1959 Greenleaf ..... 15/244.1
3,042,952 A 7/1962 Bradley
3,713,744 A * 1/1973 Sims ..... 401/9
2002/0174502 A1 * 11/2002 Cioci ..... 15/119.2
2006/0182487 A1 8/2006 Sandoval

* cited by examiner

*Primary Examiner*—Mark Spisich
(74) *Attorney, Agent, or Firm*—Dorr, Carson & Birney, P.C.

(57) ABSTRACT

An apparatus for cleaning a baseboard of a wall generally comprises an extendable handle to which a friction decreasing device such as a wheel, an adsorbent/desorbent pad and a pad compression device are assembled in a manner such that the lower end of said apparatus can be immersed in a bucket of water.

20 Claims, 7 Drawing Sheets

BASEBOARD CLEANING APPARATUS

BACKGROUND OF THE INVENTION

1. Field of the Invention

The present invention is concerned with apparatus for cleaning baseboards of walls in commercial buildings, residences, institutional buildings and the like. More particularly, this invention relates to baseboard cleaning apparatus whose cleaning pad (e.g., a synthetic sponge) is repeatedly immersed in a bucket of water in order to repeatedly clean said pad during the course of a baseboard cleaning operation.

2. Discussion of the Background

Baseboards of walls are often cleaned by hand. This requires the worker to repeatedly bend, stoop and kneel. These motions are uncomfortable at best, and sometimes even injurious (especially to a worker's lower back region). Consequently, several devices have been proposed to make the task of cleaning baseboards easier. For example, U.S. Patent Publication No. 2006/0182487 A1 discloses a baseboard cleaner having two vertically and horizontally adjustable pads (e.g., a cleaning pad and a drying pad) configured to simultaneously contact a baseboard. This baseboard cleaner further comprises a liquid dispenser, a handle that may be angled rearward and away from the wall, and a roller means such as a set of wheels. U.S. Pat. No. 3,042,952 teaches a baseboard cleaner having a pair of upright plates to which cleaning pads are affixed. A handle is pivotally mounted between the plates. This baseboard cleaner is carried on a pair of rollers. Thus, these two pad baseboard cleaning devices tend to be relatively large, complex, cumbersome and not readily suited to baseboard cleaning operations wherein the cleaning pads are repeatedly immersed in a bucket of water and squeezed in order to clean such pads.

SUMMARY OF THE INVENTION

The baseboard cleaning apparatus of this patent disclosure is sized, adapted and arranged such that its lower region—and especially its single water adsorbent/desorbent cleaning pad can be immersed in a bucket of water. Most commonly available cleaning buckets hold from about 3 to about 4 gallons of water and have open tops that are from about 8 to about 12 inches in diameter. Thus, the width W (see FIG. 3) of the widest part of the lower region of Applicant's baseboard cleaning apparatus will normally be from about 7 inches to about 11 inches so that its cleaning pad can be immersed in most commonly available cleaning buckets (see FIG. 3).

After the cleaning pad has been so immersed in a bucket of water, it needs to be squeezed to drive off excess water so that the pad is "damp" as opposed to being saturated with water. Applicant's pad squeezing action is accomplished through use of the following apparatus elements fabricated and used in the manner hereinafter described. First, a water adsorbent/desorbent pad is affixed (e.g., by use of an adhesive, fastener device, etc.) to a flexible polymer sheet. The flexible polymer sheet is then mounted to a hinge device comprised of a first plate, a hinge pivot device and a second plate. A first portion of the flexible polymer sheet (and the portion of the pad associated with it) is mounted (e.g., by screws, bolts, other fastener devices, adhesives, etc.) to the first plate. A second portion of the flexible polymer sheet (and the portion of the pad associated with it) is mounted (e.g., by screws, bolts, other fastener devices, adhesives, etc.) to the second plate. The first plate can be rigidly attached to the hinge pivot device or it can be rotatably attached to said device. The second plate must however be rotatably attached to the hinge pivot device.

The second plate is rotated (by a force supplied by a human hand and against an opposing force supplied by a biasing device such as a spring) with respect to the first plate in order to squeeze a second portion of the water adsorbent/desorbent pad against a first portion of that pad and thereby squeeze water from said pad in order to get it in a damp condition—as opposed to being saturated with excess water that may cause streak marks on the baseboard and/or wall. The second plate is also provided with a handle anchoring device that is affixed to the second plate (e.g., affixed to the second plate's underside, edges, etc.). The handle anchoring device is, in turn, attached (e.g., pivotally attached) to a pad squeezing handle adapted and arranged to receive a force, supplied by a human hand, that rotates the second plate about the hinge pivot device.

The first plate, hinge pivot device, second plate, the handle anchoring device and the pad squeezing handle are mounted to a yoke-like mounting device. The yoke-like mounting device has two prongs that are each provided with a hole through which a shaft such as a bolt shaft, an axle or the like can pass. This arrangement will facilitate the mounting of the first plate (and hence the hinged pivot device, second plate, handle anchoring device and the pad squeezing handle that are attached to it) to the yoke-like mounting device.

The yoke-like mounting device is provided with a yoke post that is attached to an apparatus handle. In one particularly useful embodiment of this invention, the yoke post is attached to a slidable component of the apparatus handle in order to provide a method by which the height of the pad can be adjusted in order to clean baseboards of varying heights. Another particularly useful embodiment provides for further adjusting the length of the apparatus handle to accommodate the comfort of workers of different physical statures. Finally, the forward advance of the wallboard cleaning apparatus is greatly aided by mounting a friction decreasing device such as one or more wheels, rollers or sled runners to the bottom of the apparatus handle.

DETAILED DESCRIPTION OF THE INVENTION

Figure 1:
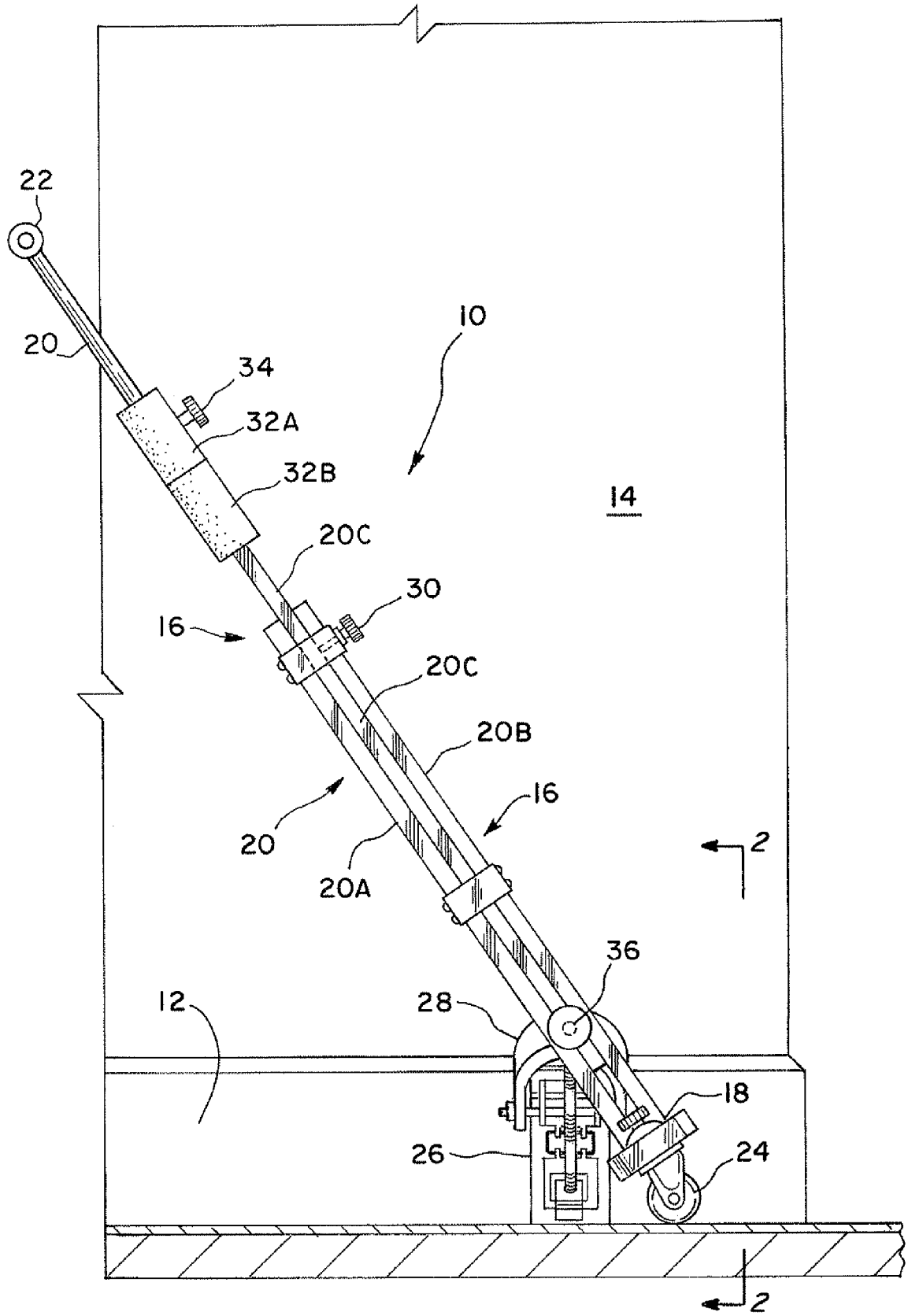
FIG. 1 is an elevation view of the baseboard cleaning apparatus of this patent disclosure.

FIG. 1 is an elevation view of the baseboard cleaner apparatus 10 of this patent disclosure. It also shows a baseboard 12 of a wall 14. The apparatus 10 has an apparatus handle 16 having a base 18, a middle region 20 and a hand grip 22. The hand grip 22 is shown mounted in an orientation such that it projects away from the wall 14. The base 18 of the apparatus handle 16 serves as a convenient mounting location for a friction decreasing device 24 such as one or more wheels, one or more axle mounted spherical rollers or one or more sled type runners. These friction decreasing devices also serve as outrigging elements that serve to stabilize the apparatus 10 as it moves forward as well as serving to decrease friction with the floor as said apparatus is advanced.

The middle region 20 of the handle 16 can be extendable in nature. For example such extendibility can be achieved through use of a middle region 20 comprised of two fixed outside handle components 20A and 20B between which a middle handle component 20C is slidably mounted in order to make the overall handle 16 extendable in nature. Since the cleaning pad 26 is (indirectly, via the first plate) mounted to a yoke 28 that is attached to the slidable middle handle component 20C, the working length of the handle 16 can be controlled through the use of this slidable middle handle component 20C in conjunction with a keeper device 30 that serves to hold the cleaning pad 26 at some desired position with respect to the baseboard. The handle 16 also may be provided with a second extension device 32A/32B such as a slidably mounted (e.g., telescoping) device (whose desired position is also maintained through use of a keeper 34) in order to make the working height of the hand grip 22 adjustable with respect to varying physical statures of cleaning personnel.

Figure 2:
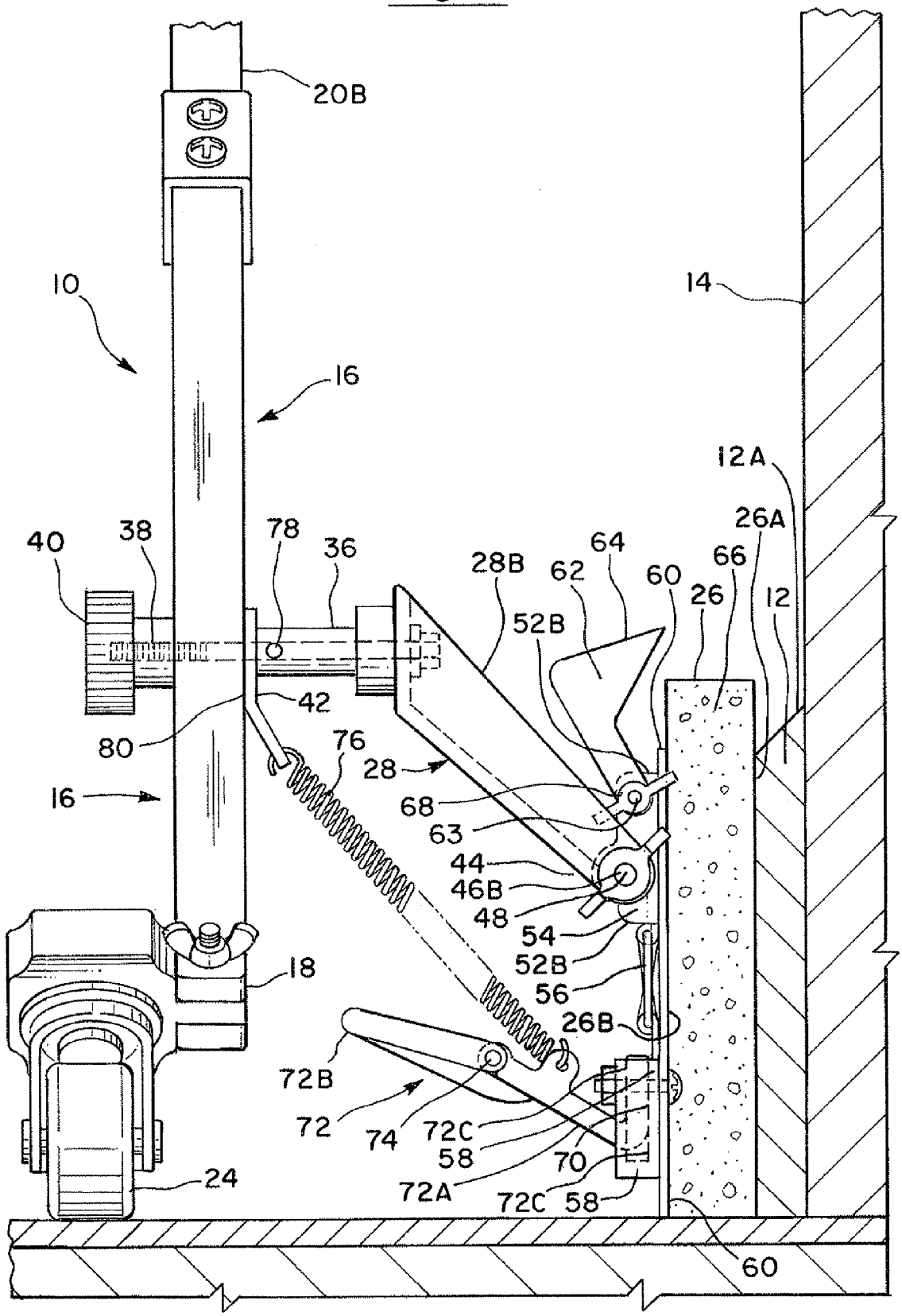
FIG. 2 is a side view of the baseboard cleaning apparatus shown in FIG. 1.

FIG. 2 is a front view of the baseboard cleaning apparatus 10 shown in FIG. 1. It shows a yoke prong 28B of yoke 28 attached to the slidable middle handle component 20C (see FIG. 1) by means of a yoke post 36 having a threaded end 38 that is shown engaged with a fastener device 40 such as a nut. A spring mounting washer 42 is also shown being penetrated by yoke post 36. The lower end 44 of yoke prong 28B is provided with a hole 46B. A counterpart hole exists in yoke prong 28A. As is better seen in FIG. 4, this hole 46B in yoke prong 28B (along with a counterpart hole in counterpart yoke prong 28A) allows passage of a mounting shaft 48 (or mounting axle or mounting bolt) through said hole 46B. Such a mounting shaft 48 will also pass through a hole 50B (see FIG. 4) in a vertical portion 52B of a first plate 54. This hole 50B generally coincides with a counterpart hole 46B in yoke prong 28B.

Figure 3:
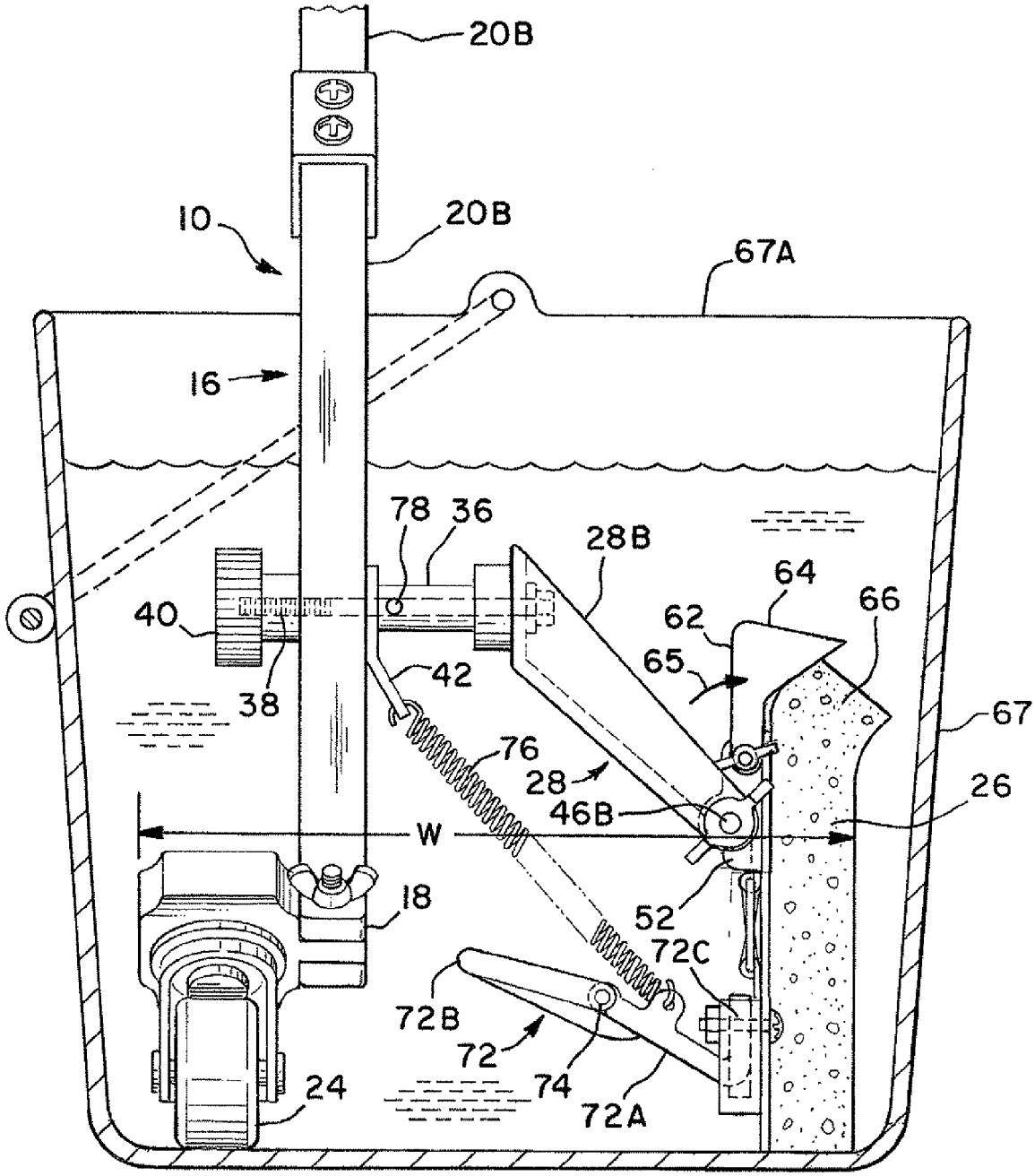
FIG. 3 is another side view of the baseboard cleaning apparatus showing said apparatus in an operating mode particularly adapted to cleaning the top edge of a baseboard.
Figure 4:
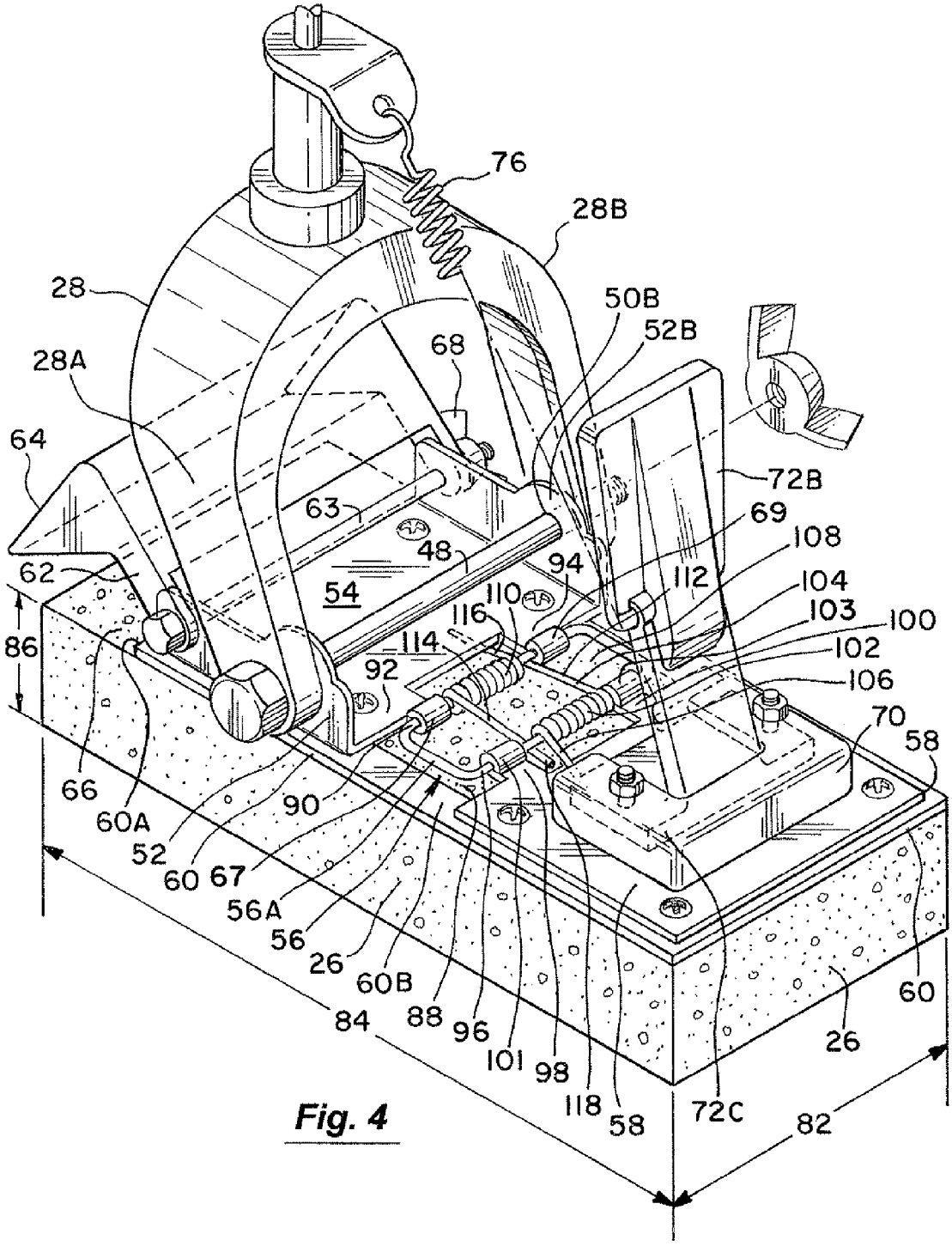
FIG. 4 is a perspective view of the cleaning pad and certain mechanical components closely associated with said pad.

As will be better seen in FIG. 4, the first plate 54 is connected to a hinge pivot device 56 that, in turn, is connected to a second plate 58. The first plate 54 and the second plate 58 are both attached to a flexible polymeric sheet 60 that is affixed to the pad 26. Thus, the pad 26 normally has a flat front face 26A and a flat rear face 26B. FIG. 2 also depicts the sideboard cleaning apparatus 10 provided with a rotatable arm 62 (mounted on pivot shaft 63) having a head 64 for bending a top portion 66 of the pad 26 inwardly in order to clean the top edge 12A of baseboard 12. The rotatable arm 62 can be rotatably mounted to the vertical portion 52B of the first plate 54 by means of its own pivot shaft 63 as shown in FIGS. 2 and 4. The rotatability of the arm 62 can be controlled through use of a keeper device 68 that enables the rotatable arm 62/head 64 device to hold the top portion 66 of the pad 26 in a bent orientation such as that depicted in FIG. 3.

FIG. 2 also shows the second plate 58 provided with a handle anchoring device 70. It is attached to a handle component 72A via an anchor device 72C. The pad squeezing handle 72 may comprise two portions 72A and 72B that are pivotally connected by a pivot device 74. The pad squeezing handle 72 is shown connected to a biasing device 76 (such as a spring or an elastomeric strip, band, tube, etc.). The other end of the biasing device 76 is, by way of illustration, shown attached to the spring mounting washer 42. The spring 76 could also be attached to the yoke post 36 by means of a fastener (not shown) that passes through a hole 78 in the yoke post 36. It could also be attached to the handle 16 at some convenient point 80.

FIG. 3 depicts the baseboard cleaning apparatus of FIG. 2 in the situation wherein the rotatable arm 62 has been rotated in a manner suggested by direction arrow 65 such that the head 64 of the rotatable arm has bent a top portion 66 of the cleaning pad 26 so that said top portion 66 can clean the top edge 12A of a baseboard 12 such as the one shown in FIG. 2. Moreover, FIG. 3 depicts the bottom of the baseboard cleaning apparatus 10 immersed in a bucket 67 containing water having a depth sufficient to immerse the cleaning pad 26. The width W of the apparatus 10 will generally be from about 7 to about 11 inches so that said apparatus will fit in a water bucket whose top lip 67A has a diameter of from about 8 to 12 inches.

FIG. 4 is a perspective view of the cleaning pad 26 and some of the mechanical components closely associated with that pad. The pad 26 will generally have a width 82 from about 2.5 inches to about 3.5 inches, a length 84 from about 5.5 inches to about 7 inches and a thickness 86 of from about 0.75 inches to about 1.5 inches. The pad 26 may comprise one or more plies of pad material. It will be made of a synthetic sponge-like material capable of readily adsorbing and desorbing water. The pad 26 is affixed (through use of an adhesive, fastener device, etc.) to a sheet 60 of flexible polymeric material whose top and bottom surfaces are substantially flat. In a particularly effective embodiment of this invention, a generally centrally located region 88 of the flexible polymeric material sheet 60 will be removed in order to make said sheet more flexible in this centrally located region 88 in order to facilitate bending said sheet 60, and the pad 26 affixed to it, to a bending angle °B ranging between about 130 degrees and about 180 degrees as generally suggested in FIG. 6. FIG. 4 also illustrates how an upper portion 66 of the pad 26 will extend beyond the upper edge 60A of sheet 60 in order to facilitate bending this upper portion 66 of the pad 26 in the manner shown in FIG. 3.

FIG. 4 also depicts a particularly effective embodiment of this invention wherein the hinged pivot device 56 has the form of an elongated ring 56A. It too is generally located near the central region of the pad 26. The first plate 54 is shown attached to the left side 90 of the elongated ring 56A. The first plate 54 can be rigidly attached to said left side 90 of the elongated ring 56A, or it can be rotatably attached to this side of the ring by one or more extension arms having looped ends e.g., extension arms 92 and 94 respectively having looped ends 67 and 69 that loosely surround the left side 90 of the elongated ring 56A and thereby allowing rotation of the first plate 54 with respect to the left side 90 of the elongated ring 56A.

Figure 6:
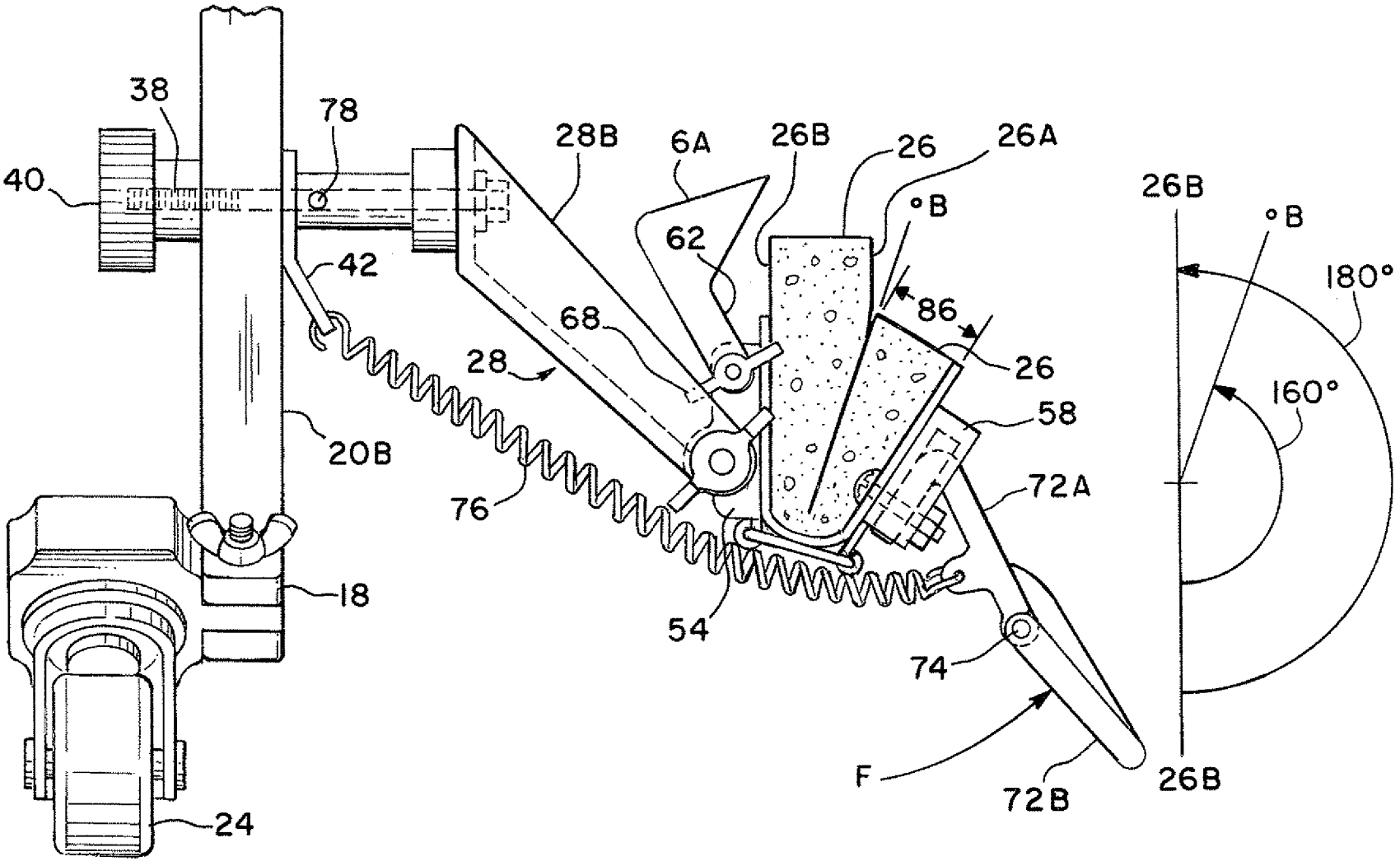
FIG. 6 illustrates a manner in which the cleaning pad can be compressed against itself in order to squeeze excess water out of said pad.

The second plate 58 is rotatably mounted to the right side 96 of the elongated ring 56A. This can be readily accomplished by providing the second plate 58 with one or more extension arms (e.g., extension arms 98 and 100) respectively having loosely fitting looped ends 101 and 103 that substantially surround the body of the right side 96 of the elongated ring 56A and thereby allowing free rotation of the second plate 58 about the right side 96 of the elongated ring 56A. This will allow the pad 26 to be bent in the manner generally suggested in FIG. 6. FIG. 4 also depicts the right side 96 of the elongated ring 56A surrounded by a coiled spring 102. This coiled spring 102 has a top spring anchor arm 104 and an opposingly directed bottom spring anchor arm 106. These opposingly directed anchor arms 104 and 106 are biased in a generally horizontal orientation (i.e., parallel to the top surface 60B of flexible polymeric sheet 60). For example the end 108 of top spring anchor arm 104 is shown positioned under the left side 90 of the elongated ring 56A. Similarly, the bottom spring anchor arm 106 of coil spring 102 is shown positioned under the second plate 58. This arrangement serves to bias the second plate 58 back to a parallel orientation with respect to the top surface 60B of the sheet after it has been bent over in order to squeeze water from the pad 26 as depicted in FIG. 6. The left side 90 of the elongated ring 56A is shown surrounded by a comparable coil spring 110 having opposingly directed anchor arms 112 and 114. The end 116 of top spring anchor arm 112 is shown positioned under first plate 54. Similarly, the end 118 of bottom spring anchor arm 114 is shown positioned under the right side 96 of the elongated ring 56A. Thus, coil springs 102 and 110 each serve to bring the pad 26 back to the generally flat orientation depicted in FIG. 4 after the pad 26 has been bent in the manner depicted in FIG. 6.

Figure 5:
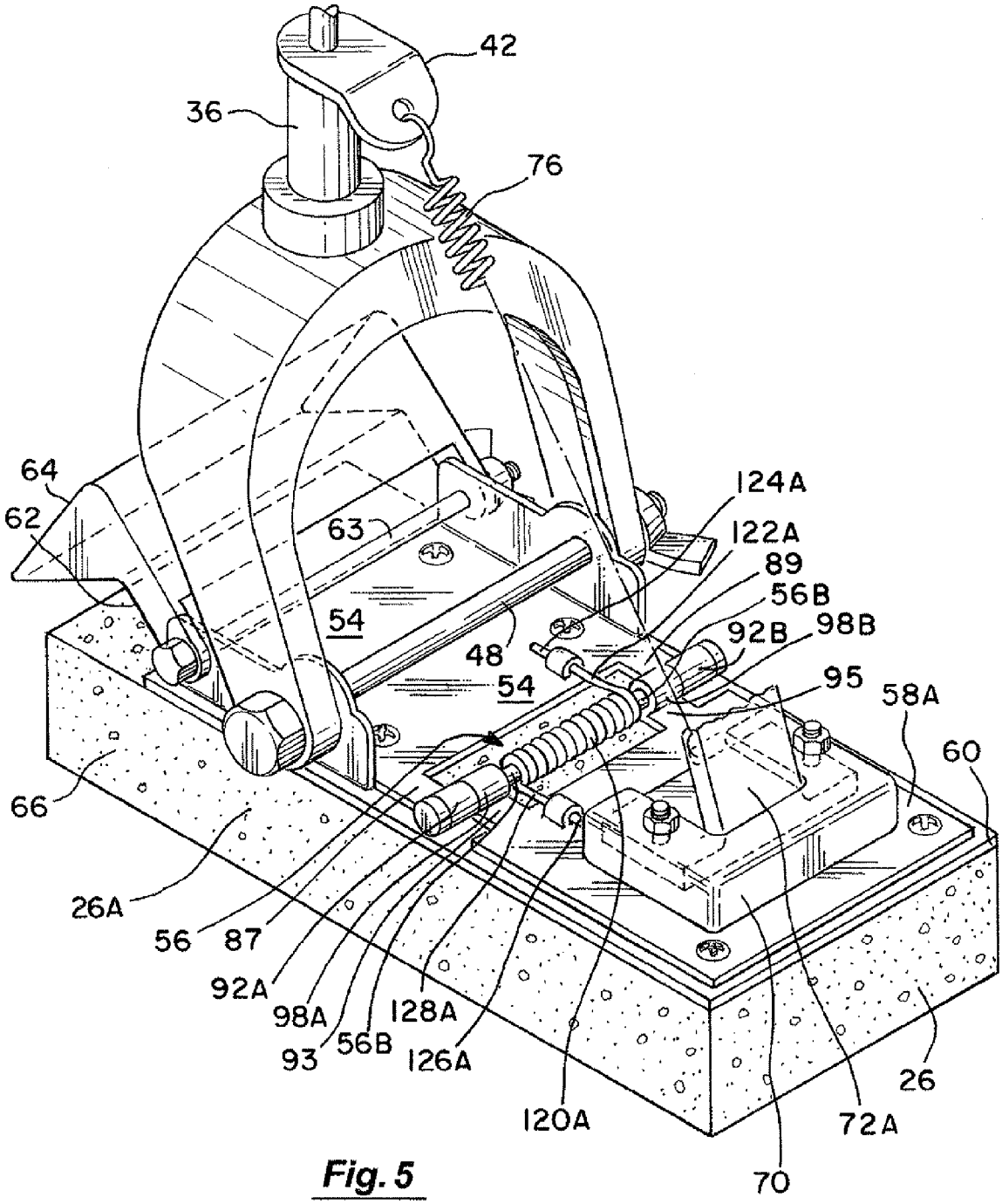
FIG. 5 depicts an embodiment of this invention employing an alternative pivot device.

FIG. 5 illustrates an alternative embodiment of this invention wherein the hinge pivot device 56 has a single hinge pivot post 56B. The first plate 54 can be rigidly affixed to the hinge pivot post 56B—or the first plate 54 can be rotatably mounted to said hinge pivot post 56B in the manner generally illustrated in FIG. 5. To this end, the first plate 54 is shown provided with extension arms 87 and 89 respectively having looped ends 92A and 92B that loosely surround the single hinge pivot post 56B. The second plate 58 is provided with comparable extension arms 93 and 95 whose respective ends 98A and 98B also loosely surround the single hinge pivot post 56B. The single hinge pivot post 56B is also shown provided with a single coiled spring 120A having a top anchor arm 122A whose end 124A is attached to the first plate 54. Similarly, the end 126A of the opposingly directed bottom anchor arm 128A is attached to the second plate 58. Thus, the single coil spring 120A that surrounds the single hinge pivot post 56B and serves to bring the pad 26 back to the generally flat orientation depicted in FIG. 5 after that pad 26 has been bent in the manner suggested in FIG. 6.

FIG. 6 depicts the pad 26 being squeezed together in order to drive excess water from said pad. In effect, the pad 26 is depicted as being bent to an angle °B of about 160° (as suggested by the rotation diagram portion of FIG. 6). In general, a desirable "damp" pad 26 is achieved when second plate 58 is bent to an angle °B (with respect to the plane of the first plate 54) of from about 120° to about 180° depending upon (a) the degree of dampness desired, the force F applied to the second component 72B of the sponge squeezing handle 72 and the thickness 86 of the pad 26.

Figure 7:
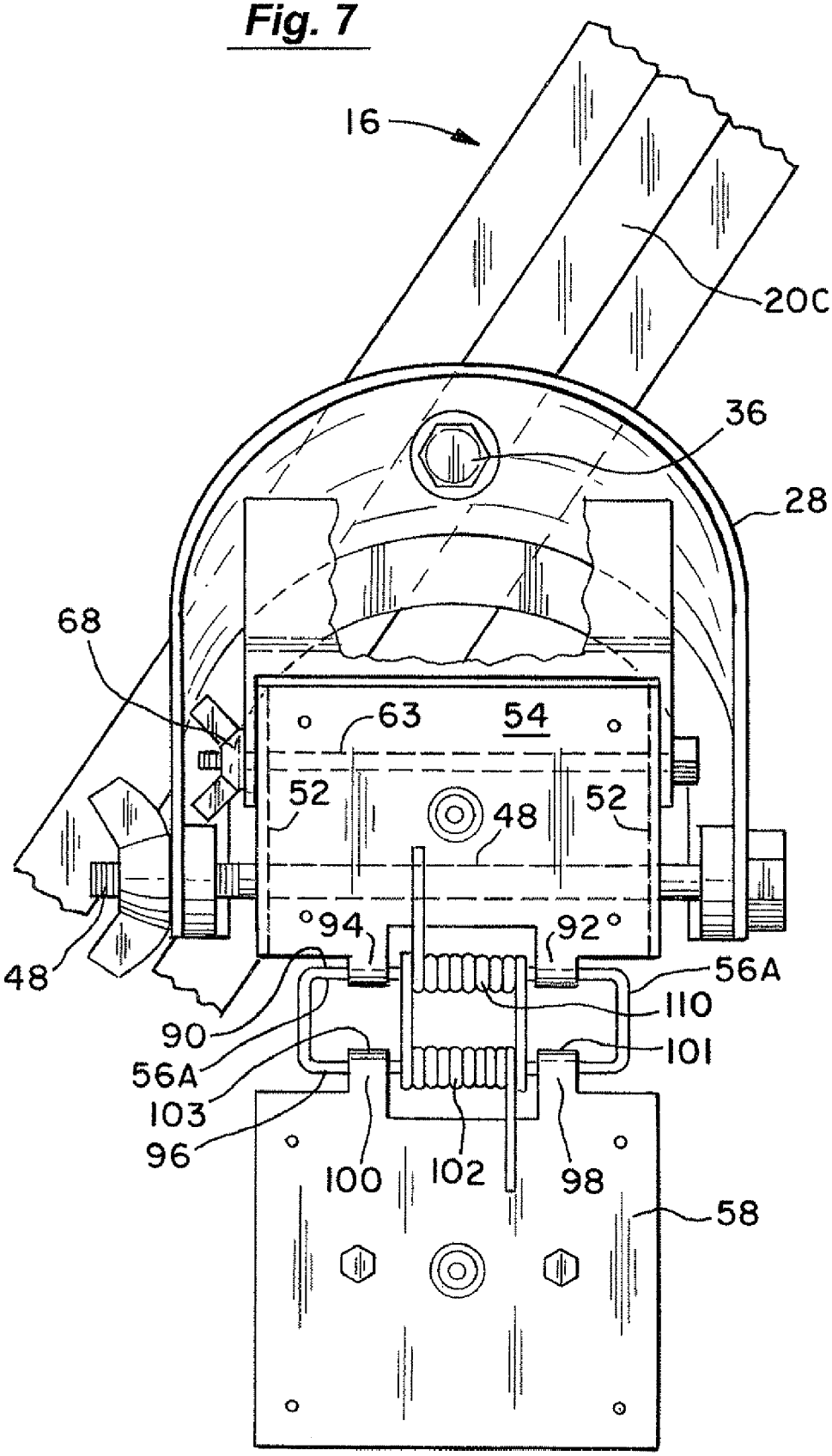
FIG. 7 is a side view of the apparatus particularly illustrating the function of its yoke component.

FIG. 7 is a side view of the lower end of the apparatus of this patent disclosure wherein the pad has been removed to better illustrate the manner in which the first plate 54 is mounted to the yoke 28. Moreover, FIG. 7 better illustrates how the yoke 28 is attached to the slidable center portion of the middle region 20C of the handle 16. It also better illustrates how the two springs (102 and 110) cooperate with the sides (90 and 96) of the elongated ring 56A.

Those skilled in this art will also appreciate that, while this invention has been described in detail and with reference to certain specific embodiments thereof, various changes and modifications can be made therein without departing from the spirit and scope of this patent disclosure.

I claim:

1. An apparatus for cleaning a baseboard of a wall, said apparatus comprising:

(1) a water adsorbent/desorbent pad having a substantially flat front face and a substantially flat rear face;

(2) a flexible polymer sheet having a top surface and a bottom surface and wherein the rear face of the water adsorbent/desorbent pad is affixed to the top surface of the flexible polymer sheet;

(3) a hinge device that is attached to a first plate and to a second plate;

(4) the first plate having a top surface and a bottom surface and: (a) has a first vertical side having a shaft receiver hole, (b) has a second vertical side having a shaft receiver hole and (c) one or more devices for affixing the bottom surface of the flexible polymer sheet to the top surface of the first plate;

(5) the second plate having a top surface and a bottom surface and is provided with a handle anchoring base that is affixed to the second plate;

(6) a yoke having (a) an upper end that is provided with a yoke post that connects the yoke to a handle, (b) a first prong having a hole for receiving a shaft, and (c) a second prong having a hole for receiving a shaft;

(7) the handle having: (a) a lower end having a base upon which a floor friction lowering device is mounted, (b) an upper end having a hand grip and (c) a middle section to which the yoke post is attached;

(8) a pad compression handle that is attached to the handle anchoring base affixed to the second plate;

(9) an elongated biasing device that extends from the pad compression handle to an opposing anchor point; and

(10) a fastener for attaching the first vertical side of the first plate to the first prong of the yoke and a fastener for attaching the second vertical side of the first plate to the second prong of the yoke.

2. The apparatus of claim 1 wherein the hinge device is comprised of a ring to which the first plate is attached and to which the second plate is rotatably attached.

3. The apparatus of claim 1 wherein the hinge device is a rod to which the first plate and second plate are each rotatably attached.

4. The apparatus of claim 1 wherein the flexible polymer sheet has a center region removed.

5. The apparatus of claim 1 wherein the rear face of the water adsorbent pad is affixed to the top surface of the flexible polymer sheet through use of an adhesive.

6. The handle of claim 1 wherein: (a) a fixed portion of said handle is comprised of two elongated rectangular posts that are spaced apart to define a center region in which a third elongated post is slidably mounted, (b) the yoke post is attached to the third elongated post and (c) the distance over which the third elongated post can slide is controlled by a keeper device and thereby controlling the working length of the handle.

7. The apparatus of claim 1 further comprising a rotatable head for bending a top portion of the water adsorbent pad.

8. The apparatus of claim 1 wherein the floor friction lowering device is selected from the group consisting of: one or more wheels, one or more axle mounted spherical rollers and one or more runners.

9. The apparatus of claim 1 wherein the pad compression handle is comprised of two handle components that are rotatably attached to each other and wherein the elongated biasing device has a first end that is attached to a handle component that is affixed to the handle anchoring base that is affixed to the second plate.

10. The apparatus of claim 1 wherein the elongated biasing device has a second end that is attached to a holding device that is attached to the yoke post.

11. The apparatus of claim 1 where the elongated biasing device is an elongated spring.

12. An apparatus for cleaning a baseboard of a wall, said apparatus comprising:

(1) a water adsorbent/desorbent pad having a substantially flat front face and a substantially flat rear face;

(2) a flexible polymer sheet having a top surface and a bottom and wherein the rear face of the water adsorbent/desorbent pad is affixed to the top surface of the flexible polymer sheet;

(3) an elongated ring having (a) a first side that is surrounded by a first coiled spring having two anchor arms that face in opposing directions and (b) a second side that is surrounded by a second coiled spring having two anchor arms that face in opposing directions;

(4) a first plate having a top surface and a bottom surface and wherein said first plate is: (a) mounted to the elongated ring, (b) has a first vertical side having a shaft receiver hole, (c) has a second vertical side having a shaft receiver hole and (d) is provided with one or more devices for affixing the bottom surface of the flexible polymer sheet to the top surface of the first plate;

(5) a second plate having a top surface and a bottom surface and: (a) rotatably mounted to the elongated ring and (b) further provided with a handle anchoring base that is affixed to the second plate;

(6) a yoke having (a) an upper end that is provided with a yoke post that connects the yoke to a vertically moveable element of an extendable handle, (b) a first prong having a hole for receiving a shaft, and (c) a second prong having a hole for receiving a shaft;

(7) the handle having: (a) a lower end having a base upon which a floor friction lowering device is mounted, (b) an upper end having a hand grip and (c) a middle section to which the yoke post is attached;

(8) a pad compression handle that is attached to the handle anchoring base affixed to the second plate;

(9) an elongated biasing device that extends from the pad compression handle to an anchor point associated with the yoke post;

(10) a fastener for attaching the first vertical side of the first plate to the first prong of the yoke; and

(11) a fastener for attaching the second vertical side of the first plate to the second prong of the yoke.

13. The apparatus of claim 12 wherein the flexible polymer sheet has a center region removed.

14. The apparatus of claim 12 wherein the rear face of the water adsorbent pad is affixed to the top surface of the flexible polymer sheet through use of an adhesive.

15. The extendable apparatus handle of claim 12 wherein said handle comprises two elongated rectangular posts that are spaced apart to define a center region in which a third elongated post is slidably mounted, (b) the yoke post is attached to the third elongated post and (c) the distance over which the third elongated post can slide can be controlled by a keeper device and thereby controlling the working location of the water adsorbent pad.

16. The apparatus of claim 12 wherein the floor friction lowering device is selected from the group consisting of: (a) one or more wheels, (b) one or more axle mounted, spherical rollers and (c) one or more runners.

17. The apparatus of claim 12 wherein the pad compression handle is comprised of two handle components that are rotatably attached to each other and wherein the elongated biasing device has a first end that is attached to a handle component that is affixed to the handle anchoring base affixed to the second plate.

18. The apparatus of claim 12 wherein the elongated biasing device has a second end that is attached to a holding device located near the yoke post.

19. The apparatus of claim 12 where the elongated biasing device is an elongated spring.

20. An apparatus for cleaning a baseboard of a wall, said apparatus comprising:

(1) a water adsorbent/desorbent pad having a substantially flat front face and a substantially flat rear face;

(2) a flexible polymer sheet having a top surface and a bottom surface and wherein a central region of the flexible polymer sheet is an open region and wherein the rear face of the water adsorbent/desorbent pad is affixed to the top surface of the flexible polymer sheet by an adhesive;

(3) an elongated ring having: (a) a first side that is surrounded by a first coiled spring having two anchor arms whose respective ends are each anchored and which face in opposing directions and (b) a second side that is surrounded by a second coiled spring having two anchor arms whose respective ends are each anchored and which face in opposing directions;

(4) a first plate having a top surface and a bottom surface and wherein said first plate is: (a) rotatably mounted the a first side of the elongated ring, (b) has a first vertical side having a shaft receiver hole, (c) has a second vertical side having a shaft receiver hole, (d) serves as a mounted rotatable arm capable of bending a top portion of the pad and (e) is provided with one or more fastener devices for affixing the bottom surface of the flexible polymer sheet to the top surface of the first plate;

(5) a second plate having a top surface and a bottom surface and wherein said second plate is: (a) rotatably mounted to the second side of the elongated ring and (b) further provided with a handle anchoring base that is affixed to the second plate;

(6) a yoke having (a) an upper end that is provided with a yoke post that connects the yoke to a vertically moveable element of an extendable handle, (b) a first prong having a hole for receiving a shaft, and (c) a second prong having a hole for receiving said shaft;

(7) the extendable handle device having: (a) a lower end having a base upon which at least one wheel is mounted, (b) an upper end having a hand grip and (c) a middle section having a fixed portion and an extendable portion to which the yoke post is attached;

(8) a pad compression handle having a first component that is attached to the handle anchoring base that is affixed to the bottom surface of the second plate and to an elongated spring and a second component that is adapted to receive a pushing force from a human hand;

(9) the elongated spring extends from the first component of the pad compression handle and a spring anchoring device that is associated with the yoke post; and

(10) a shaft for attaching the first vertical side of the first plate to a first prong of the yoke and for attaching the second vertical side to the second prong of the yoke.

* * * * *